US009033742B2

(12) United States Patent
Urano et al.

(10) Patent No.: US 9,033,742 B2
(45) Date of Patent: May 19, 2015

(54) CONNECTOR AND ILLUMINATION DEVICE

(75) Inventors: Tetsu Urano, Tokyo (JP); Takaaki Kudo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 94 days.

(21) Appl. No.: 13/806,183

(22) PCT Filed: Jul. 8, 2011

(86) PCT No.: PCT/JP2011/065679
§ 371 (c)(1),
(2), (4) Date: Dec. 21, 2012

(87) PCT Pub. No.: WO2012/014659
PCT Pub. Date: Feb. 2, 2012

(65) Prior Publication Data

US 2013/0107550 A1 May 2, 2013

(30) Foreign Application Priority Data

Jul. 28, 2010 (JP) ..... 2010-168886

(51) Int. Cl.

| | |
|---|---|
| ***H01R 13/66*** | (2006.01) |
| ***F21V 21/00*** | (2006.01) |
| ***F21V 29/00*** | (2006.01) |
| ***H01R 12/72*** | (2011.01) |
| ***H01R 13/24*** | (2006.01) |

(Continued)

(52) U.S. Cl.

CPC ..... *F21V 29/002* (2013.01); *F21K 9/1355* (2013.01); *F21V 19/0055* (2013.01); *F21V 21/00* (2013.01); *F21V 23/06* (2013.01); *F21Y 2101/02* (2013.01); *H01R 4/4818* (2013.01); *H01R 12/721* (2013.01); *H01R 13/245* (2013.01); *H01R 13/66* (2013.01)

(58) Field of Classification Search

USPC ..... 439/620.02, 79, 615

See application file for complete search history.

(56) References Cited

U.S. PATENT DOCUMENTS 6,227,912 B1 * 5/2001 Hung ..... 439/620.02
6,932,659 B1 8/2005 Wong (Continued)

FOREIGN PATENT DOCUMENTS

CN 2449369 Y 9/2001
CN 101494339 A 7/2009

(Continued)

OTHER PUBLICATIONS

Chinese Office Action dated Sep. 22, 2014 in Chinese Application No. 201180031730.2.

(Continued)

*Primary Examiner* — Hien Vu

(74) *Attorney, Agent, or Firm* — Collard & Roe, P.C.

(57) ABSTRACT

A connector (27) is adapted to be connected to a circuit board (23) and has an insulating housing (41) adapted to be mounted to one end portion of the circuit board. The housing is provided with conductive contacts (42) each having a shape along the housing. The housing has first and second portions (51, 52) that respectively face both surfaces of the circuit board when the housing is mounted to the circuit board, and a joining portion (54) joining the first and second portions together. The contacts are insulated from the circuit board in the joining portion and are exposed in the first portion so as to be capable of contacting the surface of the circuit board.

11 Claims, 9 Drawing Sheets

(51) Int. Cl.

| | |
|---|---|
| *F21K 99/00* | (2010.01) |
| *F21V 19/00* | (2006.01) |
| *F21V 23/06* | (2006.01) |
| *F21Y 101/02* | (2006.01) |
| *H01R 4/48* | (2006.01) |

(56) References Cited

U.S. PATENT DOCUMENTS

| | | | | |
|---|---|---|---|---|
| 7,575,477 | B2 * | 8/2009 | Takahashi | 439/620.02 |
| 8,025,507 | B2 * | 9/2011 | Kim et al. | 439/79 |
| 8,337,214 | B2 * | 12/2012 | Sheek | 439/56 |

FOREIGN PATENT DOCUMENTS

| | | | |
|---|---|---|---|
| EP | 2 579 392 | A1 | 4/2013 |
| JP | 1-103183 | | 7/1989 |
| JP | 05-211082 | | 8/1993 |
| JP | 07-282921 | | 10/1995 |
| JP | 08-017526 | | 1/1996 |
| JP | 2002-151216 | | 5/2002 |
| JP | 2009-093926 | | 4/2009 |
| JP | 2010-033959 | | 2/2010 |
| JP | 2010-040223 | | 2/2010 |
| JP | 3159084 | | 4/2010 |
| JP | 2010-165627 | | 7/2010 |
| WO | 2007/146566 | A2 | 12/2007 |

OTHER PUBLICATIONS

International Search Report of PCT/JP2011/065679, Oct. 11, 2011.

Supplementary European Search Report in EP 11 81 2251, mailed Mar. 6, 2014.

Chinese Office Action dated Mar. 24, 2015 in Chinese Application No. 201180031730.2 (with translation of relevant part).

* cited by examiner

CONNECTOR AND ILLUMINATION DEVICE

CROSS REFERENCE TO RELATED APPLICATIONS

This application is the National Stage of PCT/JP2011/065679 filed on Jul. 8, 2011, which claims priority under 35 U.S.C. §119 of Japanese Application No. 2010-168886 filed on Jul. 28, 2010, the disclosures of which are incorporated by reference. The international application under PCT article 21(2) was not published in English.

TECHNICAL FIELD

This invention relates to a connector and an illumination device incorporating the connector.

BACKGROUND ART

In recent years, there have been proposed various illumination devices using light-emitting diodes (hereinafter referred to as "LEDs") as light-emitting elements (see Patent Documents 1 to 3). This type of illumination device has a problem that while the device is driven, heat generated from the LEDs tends to stay in the device. If the heat stays in the device, the lifetime of the LEDs is affected. In order to cope with this problem, in Patent Document 1, light-emitting elements are mounted on an upper surface of a board having a heat transfer function and the board is supported by a radiator, thereby expecting that heat in a device is effectively dissipated to the outside through the board and the radiator.

Referring to FIG. 14, the technique disclosed in Patent Document 1 will be briefly described. In a LED bulb lamp shown in FIG. 14, an LED board 2 and a globe 3 covering it are attached to a radiator 1 on its one end side and a receiving case 6 receiving therein a lighting device 5 is attached to the radiator 1 on its other end side. A base 7 is attached to the receiving case 6. The LED board 2 is provided on its one surface side with a plurality of LEDs 8 and a connector receiving portion 9. The connector receiving portion 9 is provided at a central portion of the LED board 2 and is connected to the lighting device 5 via a power feeder 12 which is inserted through a wiring hole 11 penetrating the LED board 2 in the vicinity of the connector receiving portion 9. In this manner, power can be supplied to the LEDs 8 through the power feeder 12 and the connector receiving portion 9.

PRIOR ART DOCUMENT

Patent Document

Patent Document 1: JP-A-2010-33959
Patent Document 2: JP-A-2009-093926
Patent Document 3: JP-Y-3159084

SUMMARY OF THE INVENTION

Problem to be Solved by the Invention

However, since the connector receiving portion 9 is provided so as to protrude high on the one surface side of the LED board 2, the connector receiving portion 9 blocks light from the LEDs 8 disposed on the same surface side so that a shadow is produced. In this case, a problem exists that the commercial value of the lamp is reduced.

Further, since a conductive material such as aluminum is used as the radiator 1 and the LED board 2 in order to enhance heat radiation properties, there is a possibility that an accidental voltage is applied to the LEDs 8 through the radiator 1, the LED board 2, the connector receiving portion 9, and so on. If a voltage higher than expected is applied to the LEDs 8, the LEDs 8 may be damaged. Accordingly, it is desirable to provide a structure in which even if an accidental voltage is applied from the outside, a voltage higher than expected is not applied to the LEDs 8.

It is therefore an object of this invention to provide a connector that does not protrude high from a surface of a circuit board and that can be disposed with insulating properties at an end portion of the circuit board.

It is another object of this invention to provide an illumination device that reduces the possibility of producing an unwanted shadow in operation of the device while preventing application of an unexpected high voltage to a light-emitting element.

Means for Solving the Problem

A connector as an aspect of the present invention is adapted to be connected to a circuit board having a first and a second main surface facing each other, characterized by comprising an insulating housing adapted to be mounted to one end portion of the circuit board and a conductive contact having a shape along the housing, wherein the housing comprises a first and a second portion that respectively face the first and second main surfaces when the housing is mounted to the circuit board, and a joining portion joining the first and second portions together and wherein the contact is insulated from the circuit board in the joining portion and is exposed in the first portion so as to be capable of contacting the first main surface.

An illumination device as another aspect of the present invention comprises a circuit board having a first and a second main surface facing each other, a connector connected to the circuit board, and a light-emitting element mounted on the circuit board and adapted to emit light by power supplied through the connector, characterized in that the circuit board has a circuit conductor connected to the light-emitting element and exposed on the first main surface, the connector comprises an insulating housing mounted to one end portion of the circuit board and a conductive contact extending along the housing, the housing comprises a first and a second portion respectively facing the first and second main surfaces and a joining portion joining the first and second portions together, and the contact is insulated from the circuit board in the joining portion and is exposed in the first portion so as to be in contact with the circuit board.

Effect of the Invention

A connector according to an aspect of this invention can be disposed without protruding high from a surface of a circuit board and with insulating properties at an end portion of the circuit board.

An illumination device according to another aspect of this invention can reduce the possibility of producing an unwanted shadow in operation of the device while preventing application of an unexpected high voltage to a light-emitting element.

MODE FOR CARRYING OUT THE INVENTION

Figure 1:
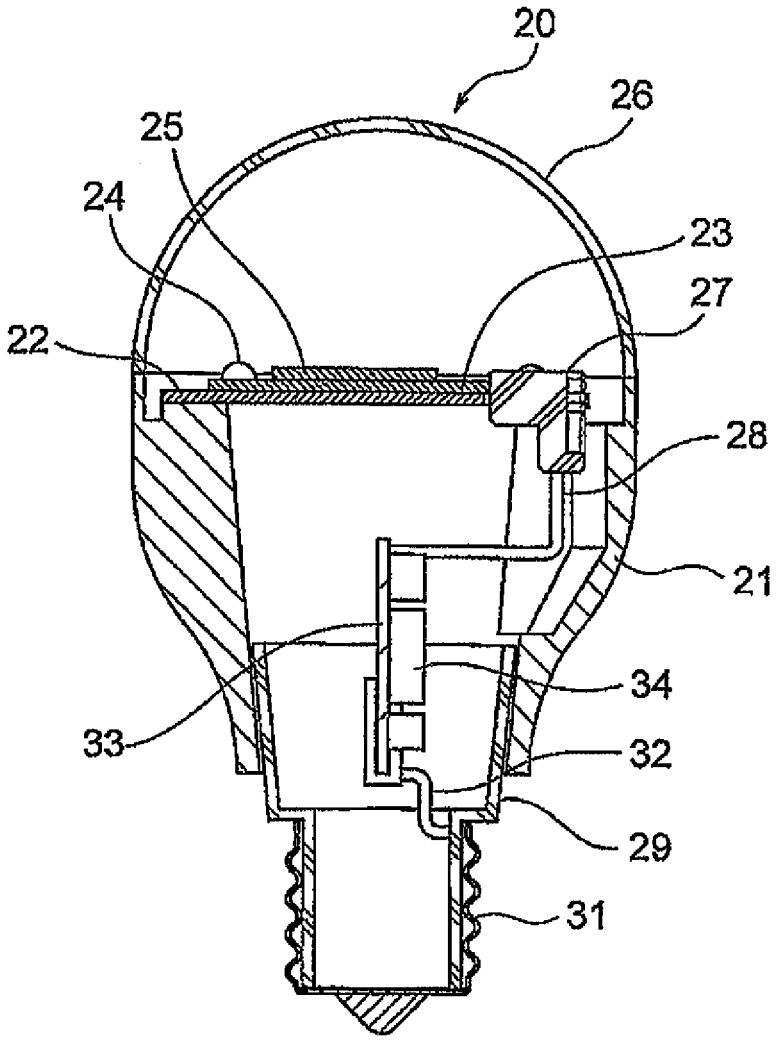
FIG. 1 is a cross-sectional view showing the overall structure of an illumination device according to an embodiment of this invention.
Figure 2:
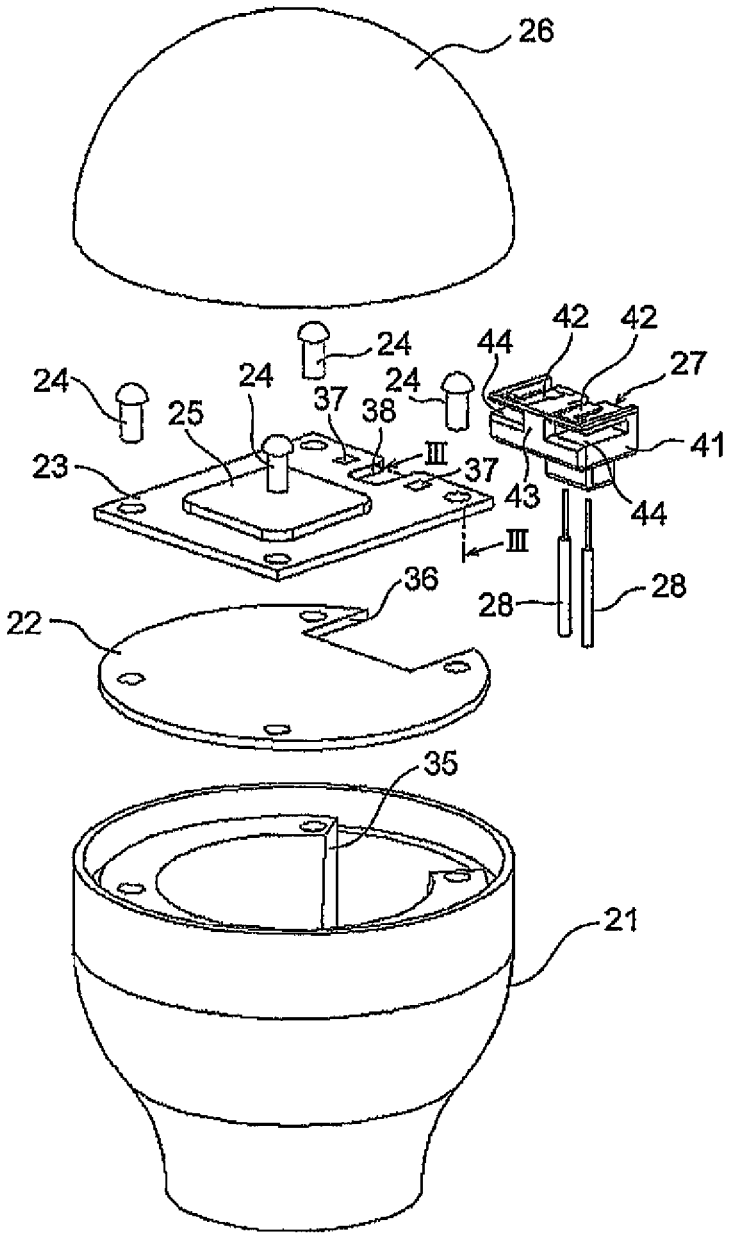
FIG. 2 is an exploded perspective view, partly omitted, of the illumination device of FIG. 1.

Referring to FIGS. 1 and 2, the overall structure of an illumination device according to an embodiment of this invention will be described.

An illumination device 20 shown in FIG. 1 is a bulb lamp in which a generally disc-shaped heat transfer member 22 is fixed at one end, i.e. on the upper end side, of a tubular heat radiating member 21 by means of screws or the like. The heat radiating member 21 and the heat transfer member 22 are each made of a metal excellent in heat transfer property, such as aluminum. Herein, a combination of the heat radiating member 21 and the heat transfer will be called a support device.

A generally square circuit board 23 is fixed to an upper surface of the heat transfer member 22 by a plurality of screws 24. One or a plurality of light-emitting elements (hereinafter referred to as "LEDs") 25 using a light-emitting diode/diodes or the like is/are integrally mounted on a first main surface, i.e. an upper surface, of the circuit board 23 at its central portion. A second main surface, i.e. a lower surface, facing the first main surface in a vertical direction, of the circuit board 23 substantially closely contacts the upper surface of the heat transfer member 22.

A domed cover 26 is also attached to the upper surface of the heat transfer member 22 so as to cover the circuit board 23 and the LED 25 with a space between itself and them. The cover 26 is made of a glass, a transparent/semitransparent resin, or the like.

A connector 27 is connected to an end portion of the circuit board 23. The connector 27 is electrically connected to the LED 25 through circuit conductors (not illustrated) provided on the upper surface of the circuit board 23. Two feed cables 28 for supplying power to the LED 25 are drawn downward from the connector 27. Herein, each feed cable 28 has a single rod-like core.

A tubular component fixing member 29 is provided at the other end, i.e. on the lower end side, of the heat radiating member 21. An upper portion of the component fixing member 29 is fixedly fitted into a lower portion of the heat radiating member 21. A lower portion of the component fixing member 29 is exposed to the outside from the heat radiating member 21 and is attached with a base 31.

A lighting board 33 electrically connected to the base 31 through two internal cables 32 is disposed in the component fixing member 29. Various electronic components 34 such as a capacitor and a transformer are mounted on the lighting board 33 and the above-mentioned two feed cables 28 are connected to the lighting board 33.

In this manner, the power can be supplied to the LED 25 through the feed cables 28, the connector 27, and the circuit board 23. Herein, a combination of the lighting board 33 and the electronic components 34 will be called a power supply device.

In FIG. 2, the tubular heat radiating member 21 has a recess 35 in its inner surface at its upper portion. The heat transfer member 22 has at its outer periphery a recess 36 corresponding to the recess 35. These recesses 35 and 36 cooperatively form a space in which the connector 27 and the feed cables 28 are disposed.

The generally square circuit board 23 is formed along its one side with two conductor portions 37 which are spaced apart from each other. These conductors 37 are exposed on the upper surface of the circuit board 23 and are connected to the above-mentioned circuit conductors. Further, the circuit board 23 is formed between the conductor portions 37 with a cutout portion 38 extending from its one end face toward its center.

The connector 27 comprises an insulating housing 41 which is mounted to one end portion of the circuit board 23, and two conductive contacts 42 extending along the housing 41. The housing 41 has a positioning portion 43 which is inserted into the cutout portion 38 of the circuit board 23, and a pair of groove portions 44 which are provided on both sides of the positioning portion 43 and into which the circuit board 23 is partially inserted. Preferably, each groove portion 44 has a size that allows insertion of the circuit board 23 with a gap therebetween.

Figure 3:
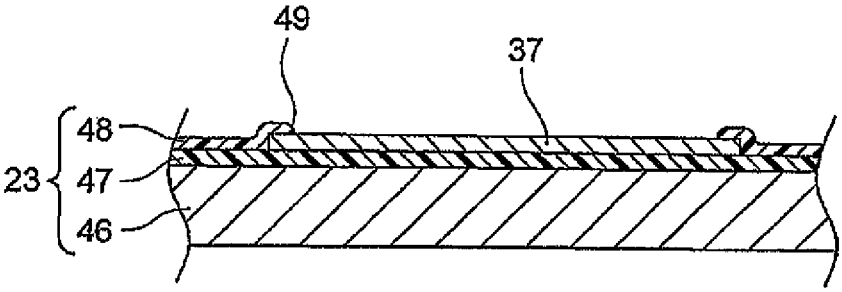
FIG. 3 is an enlarged cross-sectional end face view taken along line III-III of FIG. 2.

Referring to FIG. 3, the structure of the circuit board 23 will be described.

The circuit board 23 includes a heat transfer plate 46 made mainly of a metal such as aluminum. An insulating film 47 is formed on one surface of the heat transfer plate 46 over its entirety. On this insulating film 47, the above-mentioned circuit conductors are formed of a copper foil or the like, and further thereon, a protective layer 48 is formed which is made mainly of a white resin. Further, openings 49 are formed in the protective layer 48 to partially expose the above-mentioned circuit conductors so that the conductor portions 37 can be formed.

Figure 4:
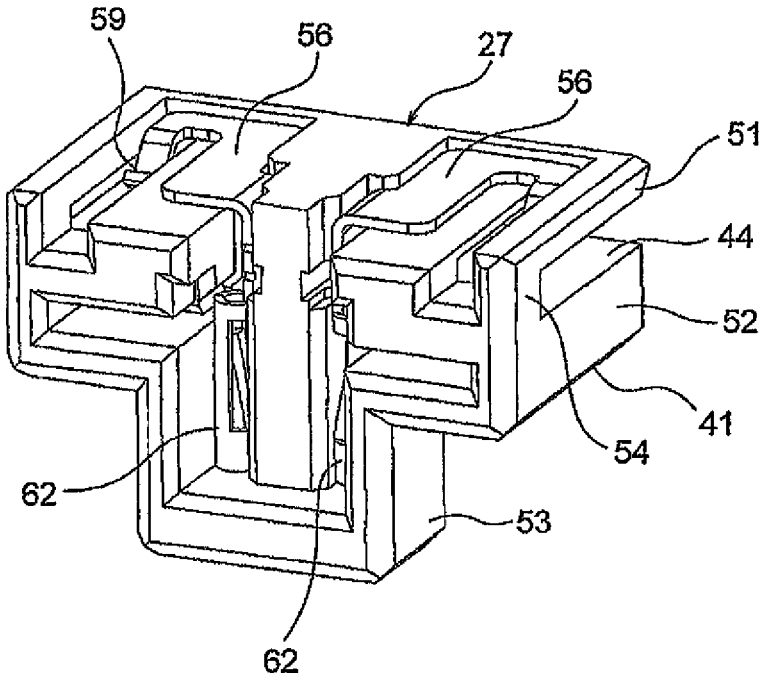
FIG. 4 is a perspective view of a connector incorporated in the illumination device of FIG. 1.
Figure 5:
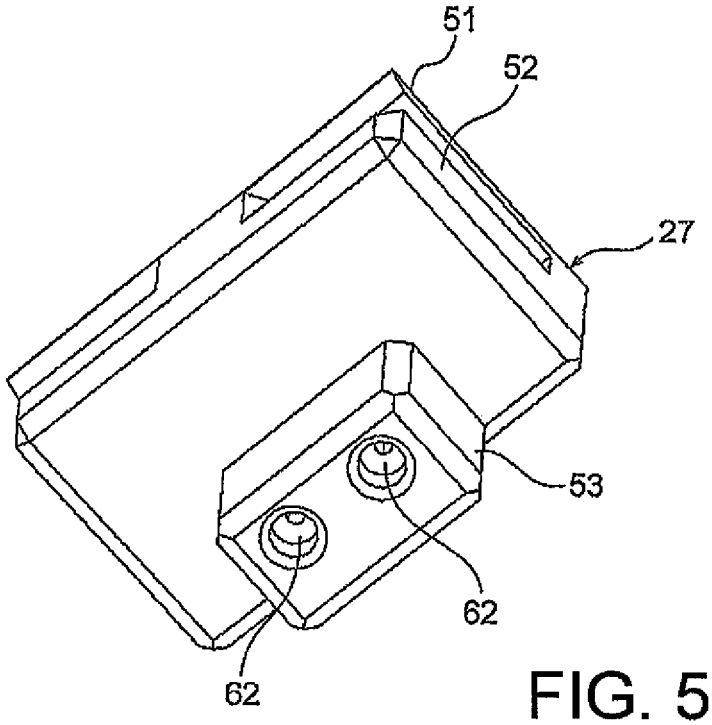
FIG. 5 is a perspective view, as seen from a different direction, of the connector of FIG. 4.
Figure 6:
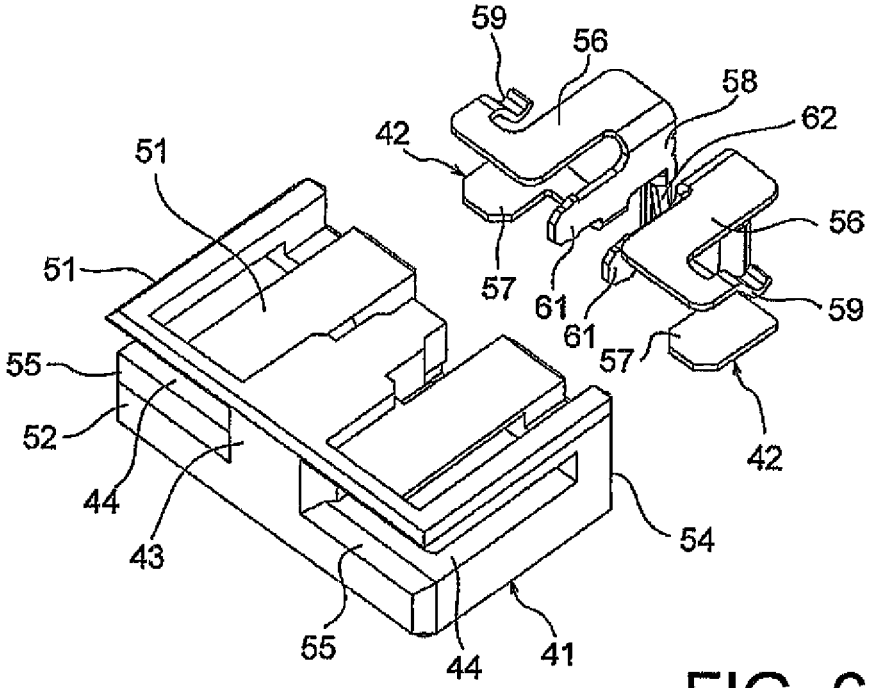
FIG. 6 is an exploded perspective view of the connector of FIG. 4.

Referring further to FIGS. 4 to 6, details of the connector 27 will be described.

The housing 41 of the connector 27 has a first portion 51 which faces the upper surface (first main surface) of the circuit board 23, a second portion 52 which faces the lower surface (second main surface) of the circuit board 23, a third portion 53 extending downward from the second portion 52, and a joining portion 54 joining the first and second portions 51 and 52 together. The groove portions 44 are formed between the first and second portions 51 and 52. Chamfering 55 is formed at an entrance of each groove portion 44 for guiding insertion of the circuit board 23. The positioning portion 43 is formed by a part of the joining portion 54 joining the first and second portions 51 and 52 together.

The two contacts 42 of the connector 27 are respectively disposed on both sides of the positioning portion 43 of the housing 41.

Each contact 42 is made of a copper alloy such as, for example, nickel silver and has a contact piece 56 extending along the first portion 51 of the housing 41, a reinforcing piece 57 extending along the second portion 52 of the housing 41, and a coupling portion 58 extending along a side surface of the positioning portion 43, which is formed by the part of the joining portion 54 of the housing 41, and coupling the contact piece 56 and the reinforcing piece 57 together. The contact piece 56 has a contact portion 59 for elastically contacting the conductor portion 37 of the circuit board 23. The reinforcing piece 57 reinforces the second portion 52.

Each contact 42 further has a fixing portion 61 connected to the coupling portion 58 and fixed to the positioning portion 43 formed by the part of the joining portion 54 of the housing 41, and a cable connecting portion 62 for connection to the feed cable 28. The cable connecting portion 62 extends from the coupling portion 58 in a direction opposite to the LED mounting surface, i.e. the first main surface, of the circuit board 23, that is, in a direction of the third portion 53, beyond the reinforcing piece 57. Herein, the cable connecting portion 62 is of the socket type that allows the rod-like core of the feed cable 28 to be fitted thereinto.

Figure 7:
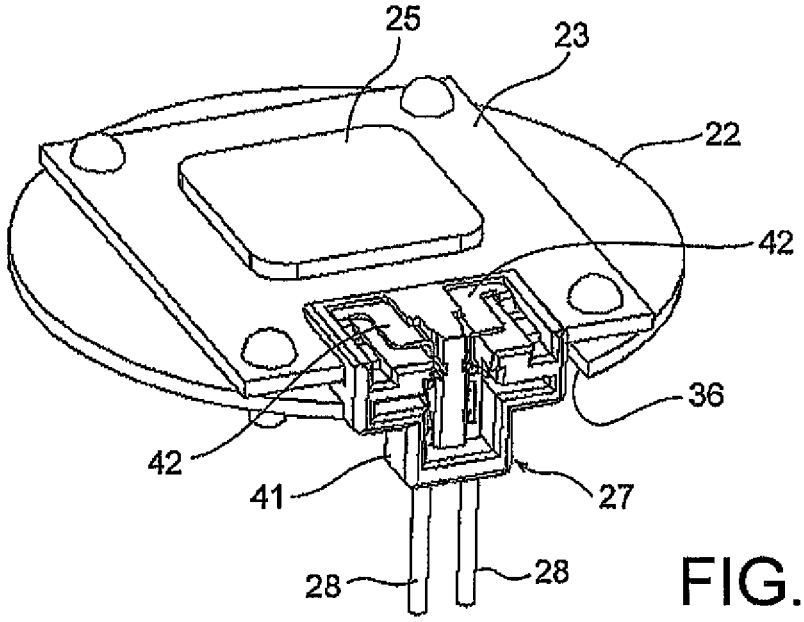
FIG. 7 is a perspective view showing only the main part of the illumination device of FIG. 1.
Figure 8:
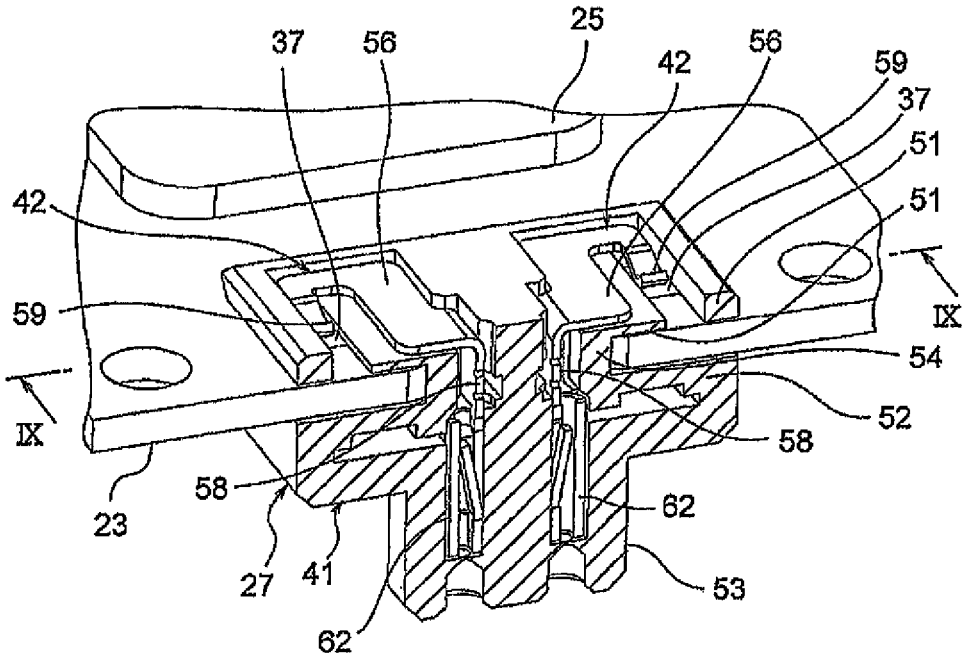
FIG. 8 is an enlarged cross-sectional view showing only part of FIG. 7.
Figure 9:
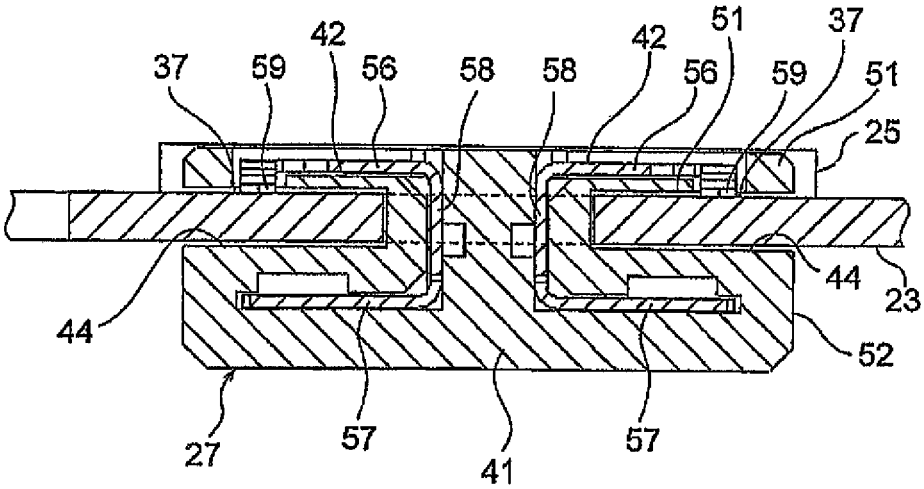
FIG. 9 is a cross-sectional view taken along line IX-IX of FIG. 8.
Figure 10:
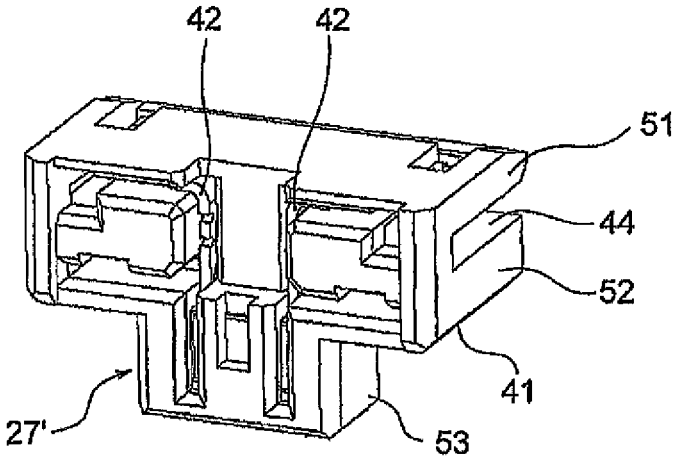
FIG. 10 is a perspective view showing a first modification of the connector shown in FIGS. 4 to 6.
Figure 11:
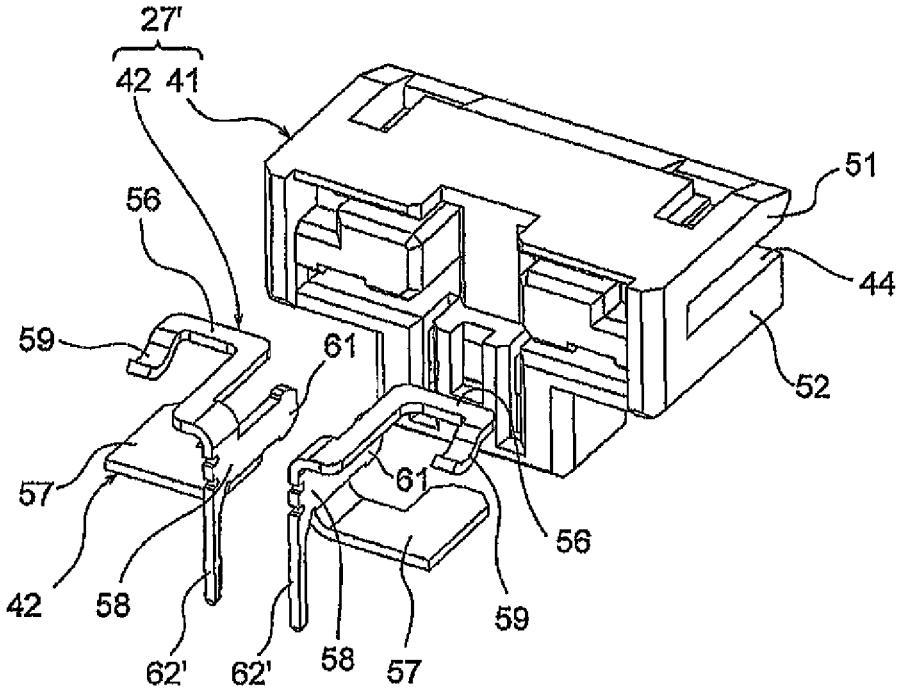
FIG. 11 is an exploded perspective view of the connector of FIG. 10.

Referring now to FIGS. 7 to 9, a description will be given of a state where the connector 27 is mounted to the circuit board 23.

When the connector 27 is mounted to the circuit board 23, the first portion 51 of the housing 41 faces the upper surface (first main surface) of the circuit board 23 and the second portion 52 of the housing 41 faces the lower surface (second main surface) of the circuit board 23. In this state, in the second portion 52, the third portion 53, and the joining portion 54 of the housing 41, the contacts 42 are insulated from the circuit board 23 by the housing 41. However, in the first portion 51 of the housing 41, the contact portions 59 of the contacts 42 are exposed to the lower surface side from the housing 41 so as to be in contact with the conductor portions 37 of the circuit board 23. Therefore, only the contact portions 59 of the contacts 42 are electrically connected to the conductor portions 37 of the circuit board 23 while there is no possibility that the other portions of the contacts 42 are electrically connected to the circuit board 23 or the conductor portions 37.

As shown particularly clearly in FIG. 9, the contact piece 56, the reinforcing piece 57, and the coupling portion 58 of each contact 42 collectively form a ]-shaped cross-section so that the contact piece 56 and the reinforcing piece 57 sandwich therebetween the first and second portions 51 and 52 of the housing 41 from the upper and lower sides of the circuit board 23. As a consequence, it is possible to prevent deformation of the housing 41 due to heat. Since the first and second portions 51 and 52 of the housing 41 do not apply a pressing force to the circuit board 23, the width of each groove portion 44 may be designed to be slightly greater so as to provide a gap for the circuit board 23.

Next, referring to FIGS. 10 to 13, modifications of the above-mentioned connector 27 will be described. Portions similar to those in FIGS. 4 to 6 are assigned the same reference symbols, thereby omitting explanation thereof.

In the connector 27 shown in FIGS. 4 to 6, the contact pieces 56 are exposed to the upper surface side from the housing 41. However, as a connector 27' shown in FIGS. 10 and 11, it may be configured such that the upper side of contact pieces 56 is covered with a first portion 51 of a housing 41.

In the connector 27 shown in FIGS. 4 to 6, the cable connecting portions 62 are of the socket type. Alternatively, as cable connecting portions 62' in the connector 27' shown in FIGS. 10 and 11, the pin type may be used.

Figure 12:
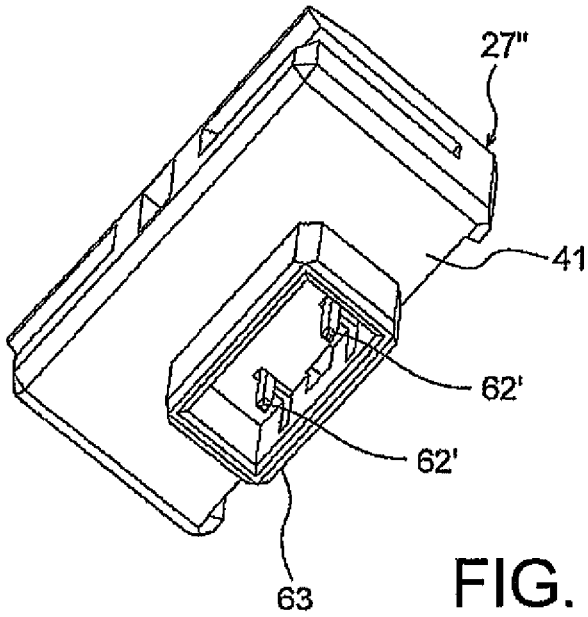
FIG. 12 is a perspective view showing a second modification of the connector shown in FIGS. 4 to 6.
Figure 13:
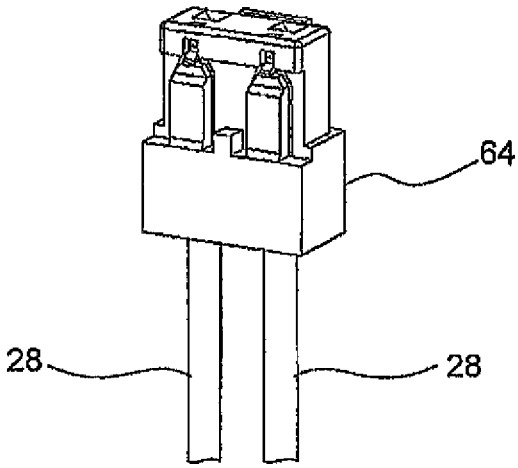
FIG. 13 is a perspective view of a mating connector which can be connected to the connector shown in FIG. 12.
Figure 14:
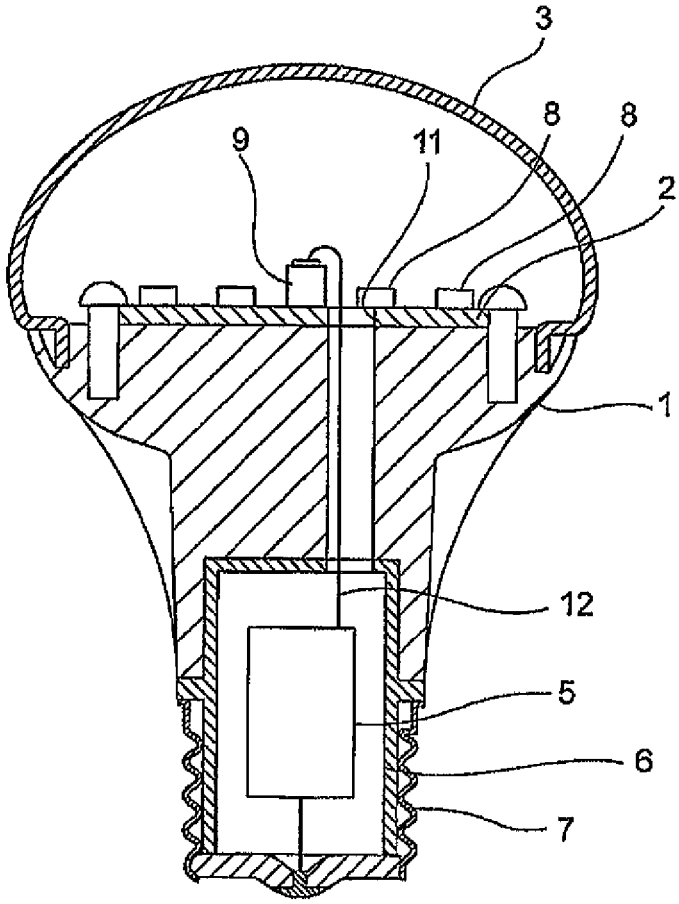
FIG. 14 is a cross-sectional view for explaining the technique disclosed in Patent Document 1 (JP-A-2010-33959).

In the case where the cable connecting portions 62' are of the pin type, as a connector 27" shown in FIG. 12, a wall portion 63 surrounding the cable connecting portions 62' may be provided to a housing 41 and a mating connector 64 connected to feed cables 28 as shown in FIG. 13 may be fitted into the wall portion 63, thereby electrically connecting the feed cables 28 to the cable connecting portions 62'.

In the case of any of the above-mentioned connectors 27, 27', and 27", the protruding length from the upper surface, where the LED 25 is mounted, of the circuit board 23 can be made small and, even if the heat transfer plate 46 made of the metal is exposed as the lower surface of the circuit board 23, there is no problem of insulation. Therefore, light from the LED 25 is not blocked so that it is possible to maximally utilize a light-emission amount as a bulb lamp.

Further, by disposing the positioning portion 43 of the housing 41 in the cutout portion 38 provided in the circuit board 23, the connector can be disposed in a space-saving manner. In particular, by using the positioning portion 43 of the housing 41 as the portion for locking the fixing portions 61 of the contacts 42 and as the portion for disposing the coupling portions 58 of the contacts 42, the outward protruding amount of the connector can be made small.

A surface color of the housing 41 is preferably white. When the surface color of the housing 41 is white, light is difficult to absorb and thus it is possible to enhance brightness as a bulb lamp. Particularly in the case of the structure in which the housing 41 covers the contacts 42 as in the connector 27', the effect is significant.

The surface color of the housing 41 can be easily made white by forming the housing 41 itself of a white resin. Alternatively, the housing 41 may be formed using, for example, a black resin and then white coating or printing is applied to or a white seal-like member is bonded to its surface exposed on the LED mounting surface side.

Part or the whole of the above-mentioned embodiments can also be described as the following supplementary notes but is not limited thereto.

(Additional Note 1)

A connector 27, 27', 27" adapted to be connected to a circuit board 23 having a first and a second main surface facing each other, characterized by comprising an insulating housing 41 adapted to be mounted to one end portion of the circuit board 23 and a conductive contact 42 having a shape along the housing 41, wherein the housing 41 comprises a first and a second portion 51 and 52 that respectively face the first and second main surfaces when the housing is mounted to the circuit board 23, and a joining portion 54 joining the first and second portions 51 and 52 together and wherein the contact 42 is insulated from the circuit board 23 in the joining portion 54 and is exposed in the first portion 51 so as to be capable of contacting the first main surface.

(Additional Note 2)

The connector according to note 1, wherein the circuit board 23 has a cutout portion 38 at the one end portion and the joining portion 54 has a positioning portion 43 that is inserted into the cutout portion 38 when the housing 41 is mounted to the circuit board 23.

(Additional Note 3)

The connector according to note 1 or 2, wherein the contact 42 comprises a contact piece 56 extending along the first portion 51, a reinforcing piece 57 extending along the second portion 52, and a coupling portion 58 extending through the joining portion 54 and coupling the contact piece 56 and the reinforcing piece 57 together.

(Additional Note 4)

The connector according to note 3, wherein the contact piece 56 has a contact portion 59 for elastically contacting the first main surface and the reinforcing piece 57 reinforces the second portion 52.

(Additional Note 5)

The connector according to any one of notes 1 to 4, wherein the contact 42 further comprises a fixing portion 61 fixed to the joining portion 54.

(Additional Note 6)

The connector according to any one of notes 3 to 5, wherein the contact 42 further comprises a cable connecting portion 62, 62' extending from the coupling portion 58 beyond the reinforcing piece 57 and capable of connecting a cable 28.

(Additional Note 7)

An illumination device 20 comprising a circuit board 23 having a first and a second main surface facing each other, a connector 27, 27', 27" connected to the circuit board 23, and a light-emitting element 25 mounted on the circuit board 23 and adapted to emit light by power supplied through the connector 27, 27', 27", characterized in that the circuit board 23 has a circuit conductor (conductor portion 37) connected to the light-emitting element 25 and exposed on the first main surface, the connector 27, 27', 27" comprises an insulating housing 41 mounted to one end portion of the circuit board 23 and a conductive contact 42 extending along the housing 41, the housing 41 comprises a first and a second portion 51 and 52 respectively facing the first and second main surfaces and a joining portion 54 joining the first and second portions together, and the contact 42 is insulated from the circuit board 23 in the joining portion and is exposed in the first portion 51 so as to be in contact with the circuit board.

(Additional Note 8)

The illumination device according to note 7, wherein the circuit board 23 further comprises a heat transfer plate 46, an insulating film 47 on the heat transfer plate 46, and a protective layer 48 on the insulating film 46, the circuit conductor extends between the insulating film 47 and the protective layer 48, the protective layer 48 has an opening 49 through which a part 35 of the circuit conductor is exposed on the first main surface, and the contact 42 is in contact with the circuit conductor through the opening 49.

(Additional Note 9)

The illumination device according to note 7 or 8, wherein the circuit board 23 has a cutout portion 38 at the one end portion and the joining portion 54 has a positioning portion 43 inserted into the cutout portion 38.

(Additional Note 10)

The illumination device according to any one of notes 7 to 9, wherein the contact 42 comprises a contact piece 56 extending along the first portion 51, a reinforcing piece 57 extending along the second portion 52, and a coupling portion 58 extending through the joining portion 54 and coupling the contact piece 56 and the reinforcing piece 57 together.

(Additional Note 11)

The illumination device according to note 10, wherein the contact piece 56 has a contact portion 59 which elastically contacts the circuit conductor 23, and the reinforcing piece 57 reinforces the second portion 52.

(Additional Note 12)

The illumination device according to any one of notes 7 to 11, wherein the contact 42 further comprises a fixing portion 61 fixed to the joining portion 54.

(Additional Note 13)

The illumination device according to any one of notes 7 to 12, further comprising a support device supporting the circuit board 23, a power supply device supported by the support device, and a cable 28 connecting the power supply device to the connector 27, 27', 27", wherein the contact 42 further comprises a cable connecting portion 62, 62' to which the cable 28 is connected.

(Additional Note 14)

The illumination device according to any one of notes 7 to 13, wherein the support device comprises a heat radiating member 21 supporting the power supply device and a heat transfer member 22 supported by the heat radiating member and wherein the circuit board 23 is mounted on the heat transfer member 22.

(Additional Note 15)

The illumination device according to any one of notes 7 to 13, wherein the support device forms a space for disposing the connector 27, 27', 27".

In the above-mentioned illumination device 20, the LED 25 is mounted on the circuit board 23 and therefore the circuit board 23 may also be called an "LED mounting board".

While this invention has been described with reference to the embodiments, this invention is not limited thereto. Various changes that can be understood by those skilled in the art can be made to the structures and details of this invention within the scope of this invention.

This application claims priority from Japanese Patent Application No. 2010-168886, filed on Jul. 28, 2010, the disclosure of which is incorporated herein in its entirety by reference.

DESCRIPTION OF SYMBOLS

20 illumination device
21 heat radiating member
22 heat transfer member
23 circuit board (LED mounting board)
24 screw
25 light-emitting element or LED
26 cover
27, 27', 27" connector
28 feed cable
29 component fixing member
31 base
32 internal cable
33 lighting board
34 electronic component
35 recess
36 recess
37 conductor portion
38 cutout portion
41 housing
42 contact
43 positioning portion
44 groove portion
46 heat transfer plate
47 insulating film
48 protective layer
49 opening
51 first portion
52 second portion
53 third portion
54 joining portion
55 chamfering
56 contact piece
57 reinforcing piece
58 coupling portion
59 contact portion
61 fixing portion
62, 62' cable connecting portion

63 wall portion

64 mating connector

The invention claimed is:

1. A connector adapted to be connected to a circuit board having a first and a second main surface facing each other, the connector comprising:

an insulating housing adapted to be mounted to one end portion of the circuit board; and a conductive contact having a shape along the housing and having an upper contact section connecting with a contact piece, wherein the housing comprises:

a first and a second portion that respectively face the first and second main surfaces when the housing is mounted to the circuit board, and a joining portion joining the first and second portions together, and wherein the upper contact section is insulated from the circuit board in the joining portion and is exposed in the first portion so that the contact piece is capable of contacting the first main surface of the circuit board, wherein the circuit board has a cutout portion at the one end portion and the joining portion has a positioning portion that is inserted into the cutout portion when the housing is mounted to the circuit board, and wherein the contact comprises the contact piece extending along the first portion, a reinforcing piece extending along the second portion, and a coupling portion extending through the joining portion and coupling the contact piece and the reinforcing piece together.

2. The connector according to claim 1, wherein the contact piece has a contact portion for elastically contacting the first main surface and the reinforcing piece reinforces the second portion.

3. The connector according to claim 1, wherein the contact comprises a fixing portion fixed to the joining portion.

4. The connector according to claim 1, wherein the contact comprises a cable connecting portion extending from the coupling portion beyond the reinforcing piece and capable of connecting a cable.

5. An illumination device comprising:

a circuit board having a first and a second main surface facing each other, a connector connected to the circuit board, and a light-emitting element mounted on the circuit board and adapted to emit light by power supplied through the connector, wherein the circuit board has a circuit conductor connected to the light-emitting element and exposed on the first main surface, the connector comprises an insulating housing mounted to one end portion of the circuit board and a conductive contact extending along the housing and having an upper contact section connecting with a contact piece, the housing comprises a first and a second portion respectively facing the first and second main surfaces and a joining portion joining the first and second portions together, and the upper contact section is insulated from the circuit board in the joining portion and is exposed in the first portion so that the contact piece is in contact with the first main surface of the circuit board, wherein the circuit board has a cutout portion at the one end portion and the joining portion has a positioning portion inserted into the cutout portion when the housing is mounted to the circuit board, and wherein the contact comprises the contact piece extending along the first portion, a reinforcing piece extending along the second portion, and a coupling portion extending through the joining portion and coupling the contact piece and the reinforcing piece together.

6. The illumination device according to claim 5, wherein the circuit board further comprises a heat transfer plate, an insulating film on the heat transfer plate, and a protective layer on the insulating film, the circuit conductor extends between the insulating film and the protective layer, the protective layer has an opening through which a part of the circuit conductor is exposed on the first main surface, and the contact is in contact with the circuit conductor through the opening.

7. The illumination device according to claim 5, wherein the contact piece has a contact portion which elastically contacts the circuit conductor, and the reinforcing piece reinforces the second portion.

8. The illumination device according to claim 5, wherein the contact further comprises a fixing portion fixed to the joining portion.

9. The illumination device according to claim 5, further comprising a support device supporting the circuit board, a power supply device supported by the support device, and a cable connecting the power supply device to the connector, wherein the contact further comprises a cable connecting portion to which the cable is connected.

10. The illumination device according to claim 5, wherein the support device comprises a heat radiating member supporting the power supply device and a heat transfer member supported by the heat radiating member and wherein the circuit board is mounted on the heat transfer member.

11. The illumination device according to claim 5, wherein the support device forms a space for disposing the connector.

* * * * *